United States Patent [19]

Dodd

[11] Patent Number: 4,570,536

[45] Date of Patent: Feb. 18, 1986

[54] ELECTRICALLY ACTUATED CAN CRUSHER

[76] Inventor: Robert N. Dodd, 6525 Casa Vista, Loomis, Calif.

[21] Appl. No.: 585,518

[22] Filed: Mar. 2, 1984

[51] Int. Cl.[4] ..... B30B 9/32

[52] U.S. Cl. ..... 100/53; 100/102; 100/256; 100/268; 100/289; 100/295; 100/902; 221/199

[58] Field of Search ..... 100/102, 289, 240, 295, 100/902, 268, 256, 53, 265; 221/102, 199; 241/99

[56] References Cited

U.S. PATENT DOCUMENTS

| | | | |
|---|---|---|---|
| 1,576,234 | 3/1926 | Cozzoli | 100/268 X |
| 2,478,815 | 8/1949 | Forman | 100/102 |
| 2,880,904 | 4/1959 | Linthicum | 221/102 X |
| 3,020,832 | 2/1962 | Sholin | 100/256 X |
| 3,352,230 | 11/1967 | Hunnicutt | 100/902 X |
| 3,761,215 | 9/1973 | Tondato | 100/268 X |
| 3,889,587 | 6/1975 | Wharton | 100/902 X |
| 3,960,070 | 6/1976 | McClure | 100/902 X |
| 4,133,261 | 1/1979 | Belfils | 100/902 X |
| 4,188,875 | 2/1980 | Fabbri | 100/295 X |
| 4,387,637 | 6/1983 | Baird | 100/295 X |

*Primary Examiner*—Billy J. Wilhite

*Attorney, Agent, or Firm*—Mark C. Jacobs

[57] ABSTRACT

An electrically actuated can crusher having a housing, a motor mounted within the housing and a shaft rotatable by the motor and downwardly driven thereby having a crush plate thereon. The housing also includes a bottom crush plate allowing a can to be crushed to be placed in the housing between the crush plates. The housing includes an access door which, when in the open position, deactivates the motor. In this manner, when the door is closed, the motor can be activated to lower the shaft crush plate to crush a can placed therebetween. The shaft crush plate may include a lever movable in a slot in the housing to align the shaft crush plate in its movement and a reversing switch may be provided in the lever and slot to reverse the direction of movement of the shaft crush plate after crushing of a can.

7 Claims, 8 Drawing Figures

ELECTRICALLY ACTUATED CAN CRUSHER

BACKGROUND OF THE INVENTION

1. Field of the Invention

The invention relates to can crushers; and, more particularly, to an improved can crusher which is electrically operated and capable of crushing commercial beverage cans or the like of all sizes in a quick and efficient manner.

2. Description of the Prior Art

Beverage cans have been a continuing problem in today's ecology minded society. In recent years, it has been proposed to recycle such cans but such recycling requires temporary storage until the cans can be brought to a recycling center. Needless to say, the cans take up quite a bit of storage volume and various can crushing devices have been suggested to reduce can storage volume. Although side can crushing devices are known, cans crushed with devices of this type are dangerous to handle since the side crushing results in exposed sharp edges. Also, such side crushed cans do not store well since the ends are not as compacted as the center.

Vertical crushing is thus more desirable but great pressure is required usually to compress a can vertically. Heretofore, such vertical can compressing devices have been bulky and expensive, such as the crusher of Wharton disclosed in U.S. Pat. No. 3,889,587. In a patent to Belfils, U.S. Pat. No. 4,133,261, a device is disclosed which requires considerable force to crush a can. In Belfils, the crusher has a base on which the can to be crushed is placed and means for crimping one side of the can when pressure is applied to the top of the can is provided. The crimping is accomplished by a bead on the bottom base. Since the crimping means is provided by a bead, cans of varying sizes require different crushing pressures. Since the cans are not restrained in Belfils, they can buckle into a wide variety of shapes and may be forcibly ejected during crushing resulting in injury to the user.

There is thus a need for a can crusher which crushes a can vertically with the required amount of force and is attractive to view the crushing operation but safe from prying fingers.

SUMMARY OF THE INVENTION

It is an object of this invention to provide a can crusher which crushes a can verically with the desired degree of force provided electrically.

It is a further object of this invention to provide a can crusher which crushes a can in a confined chamber and is visible to view during the crushing operation.

Another object is to provide a can crusher which can be disposed within the housing of a soda or beer can vending machine.

Still another object is to provide an electric can crusher which is small and easy enough to use such as to constitute a household appliance.

It is still further object of this invention to carry out the foregoing objects in a safe manner.

These and other objects are accomplished by providing an electrically actuated can crusher having a housing, a motor mounted within the housing and a shaft rotatable by the motor and downwardly driven thereby having a crush plate thereon. The housing also includes a bottom crush plate allowing a can to be crushed to be placed in the housing between the crush plates. The housing includes an access door which, when in the open position, deactivates the motor. In this manner, when the door is closed, the motor can be activated to lower the shaft crush plate to crush a can placed therebetween. The shaft crush plate may include a lever movable in a slot in the housing to align the shaft crush plate in its movement and a reversing switch may be provided in the lever and slot to reverse the direction of movement of the shaft crush plate after crushing of a can.

BRIEF DISCRIPTION OF THE DRAWING

DESCRIPTION OF THE PREFERRED EMBODIMENT

Figure 1:
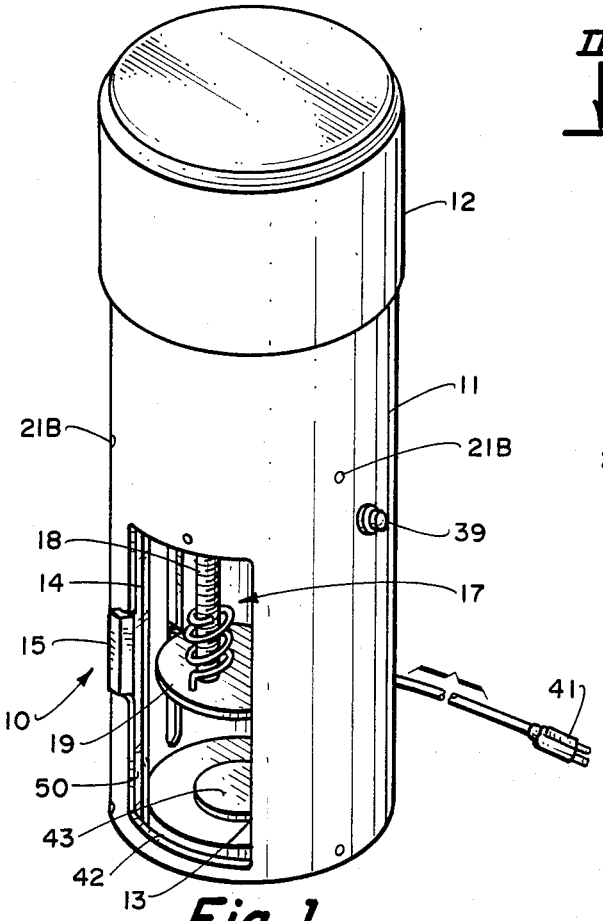
FIG. 1 is a vertical perspective view of a crusher in accordance with the invention.
Figure 2:
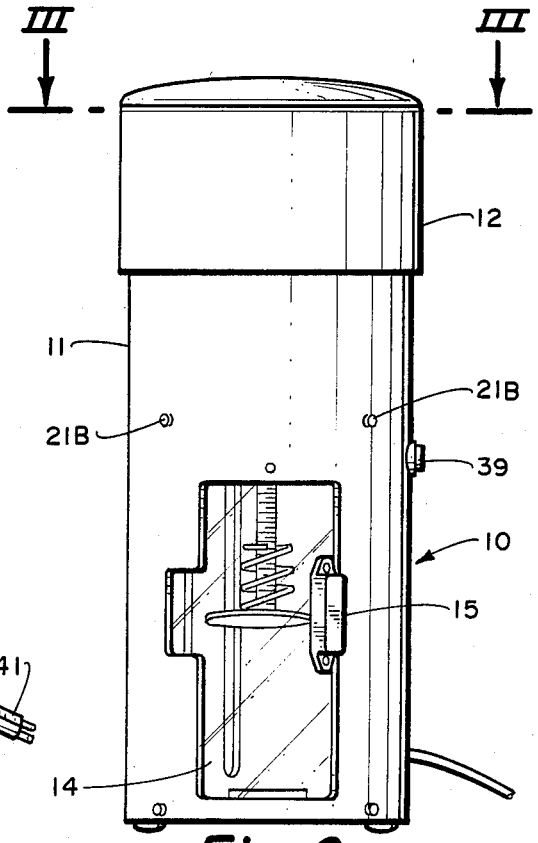
FIG. 2 is a vertical view of the crusher of FIG. 1 with the door in closed position.
Figure 3:
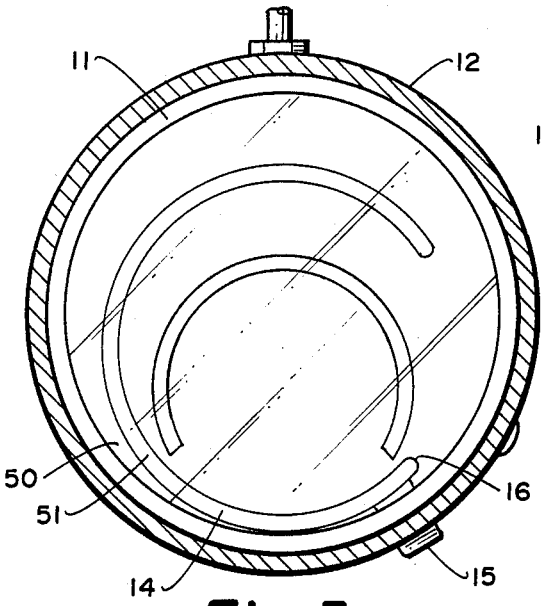
FIG. 3 is a view taken along lines III—III of FIG. 2.

Referring now to FIG. 1 of the drawing, a can crusher 10 in accordance with the invention is shown having a generally cylindrical main housing 11 telescopingly fitting into an upper generally cylindrical cap 12. Crusher 10 includes an opening 13 in main housing 11 and a door 14 (see also FIG. 2), which may be transparent and configured similarly to housing 11, adapted to close opening 13. Door 14 includes a handle 15 and is slidable internally of housing 11 so as to be selectively movable from the FIG. 1 open position to the FIG. 2 closed position. As shown in FIG. 3, door 14 may be semi-circular in configuration and disposed internally of housing 11 and operated by handle 15 to selectively align opening 16 therein with opening 13 to thereby open housing 11 (or close the same by moving handle 15 so opening 16 is no longer aligned with opening 13).

A plunger 17 is disposed internally of housing 11 and includes a vertically disposed threaded shaft 18 (see also FIG. 4) terminating at its lower end in a ram plate 19.

Figure 4:
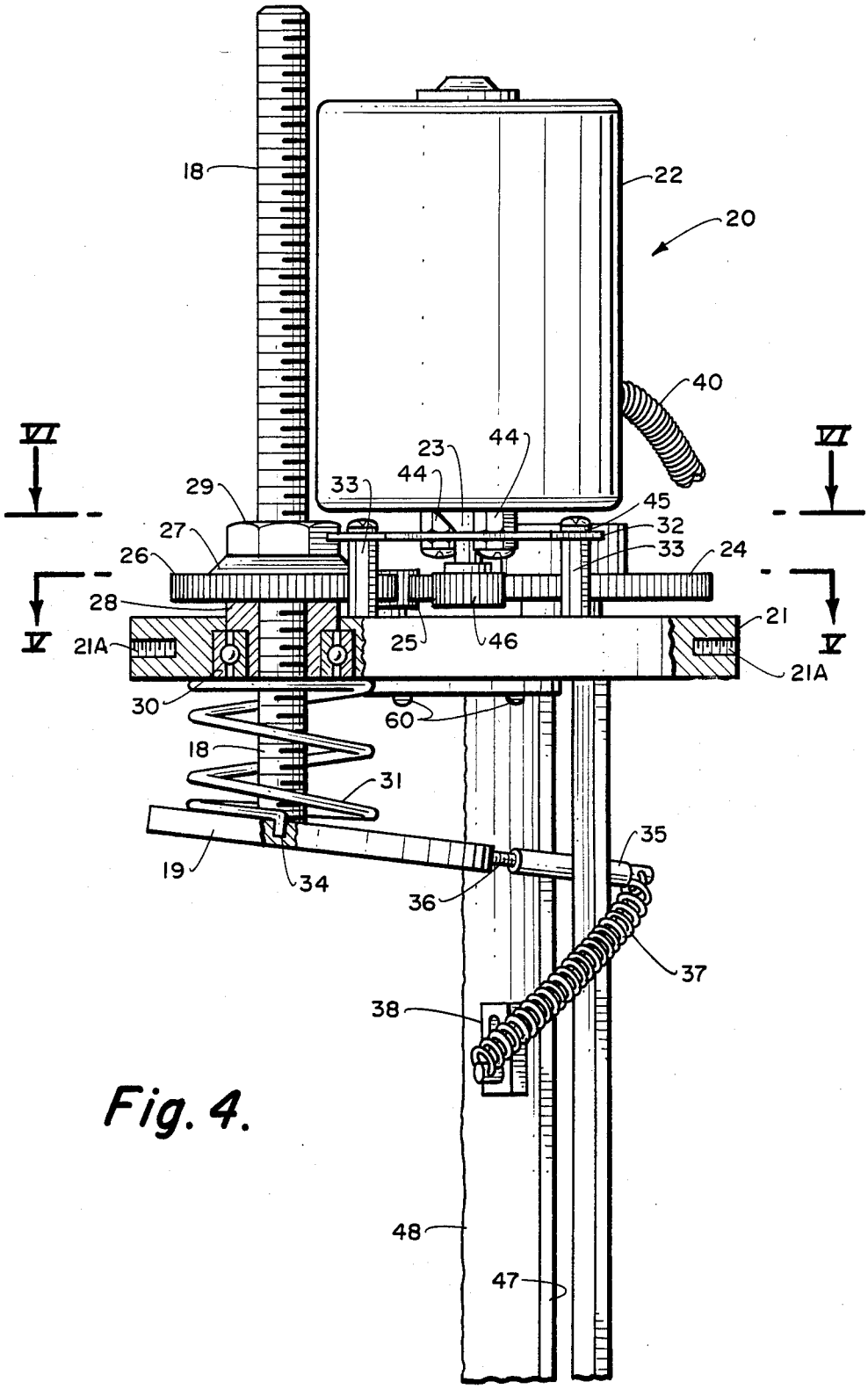
FIG. 4 is a vertical view of the operating mechanism of the crusher of FIGS. 1 through 3 removed therefrom.
Figure 5:
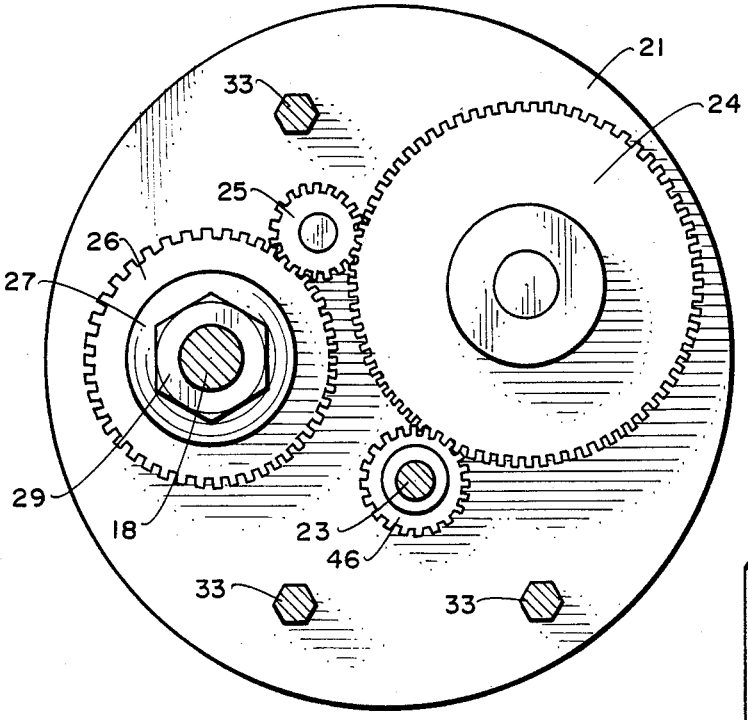
FIG. 5 is a view taken along lines V—V of FIG. 4.

Thus, FIG. 4 shows the operating mechanism 20 alone removed from the main housing 11. Mechanism 20 includes a circular plate 21 which may include threaded openings 21A about the periphery thereof for receiving screws 21B (FIG. 1) or the like therein so that mechanism 20 can be held in position within housing 11. Mechanism 20 thus includes a motor 22 having a drive shaft 23 (see also FIG. 5) driving a gear 46 (FIG. 5)-not visible in FIG. 4. Gear 46 in turn drives gear 24 which is in driving engagement with idler gear 25 which drives gear 26.

As seen in FIG. 4, shaft 18 extends through gear 26 so that, when motor 22 is actuated to drive gear 24, gear 26 is rotated thereby rotating shaft 18. This is accomplished by a threaded bushing 27 mounted on plate 21 coupled to gear 26 and fixed thereto for rotation therewith. Shaft 18 is in threaded engagement with nut 29 so that shaft 18 moves within nut 29 when gear 26 is rotated. Bushing 27 includes a circular portion 28 extending through gear 26 and a nut 29. A radial thrust bearing 30 is pressed on to the lower end of portion 28 mounted within plate 21. As seen in FIG. 4, shaft 18 extends below plate 21 and terminates in ram plate 19. A coil spring 31 surrounds shaft 18 between plate 19 and plate 21 to assist in providing initial starting thrust for the larger 16 oz. cans.

Figure 6:
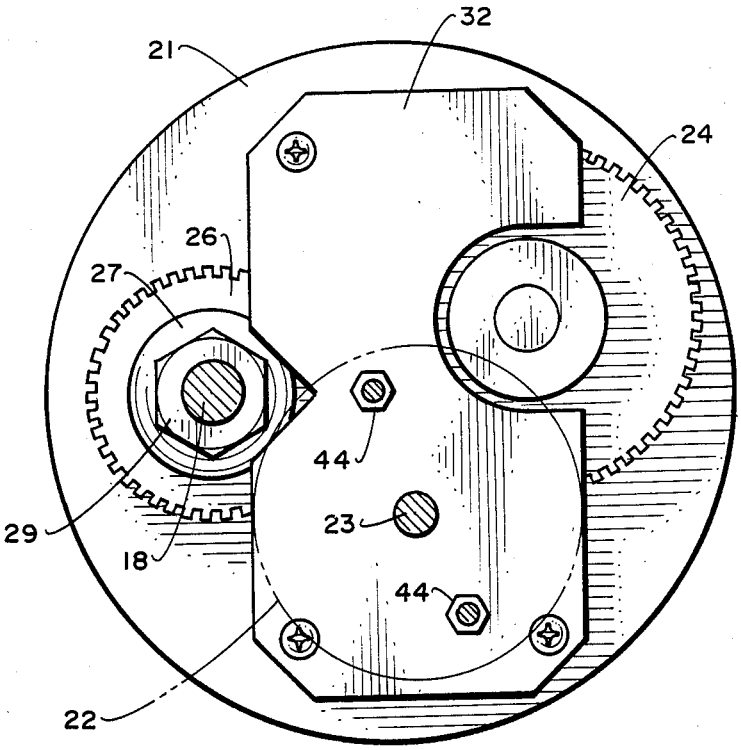
FIG. 6 is a view taken along lines VI—VI of FIG. 4.

As seen in FIG. 6, a plate 32 is mounted via shafts 33 (FIG. 4) on top of plate 21 below motor 22. Motor 22 is mounted above plate 32 (FIG. 4) via nuts and bolts 44 and spaced therefrom via spacers 45.

As seen in FIG. 1, the main housing 11 terminates at the bottom in a bottom wall 42 having a generally circular ram plate 43 for receiving the bottom of a can to be crushed therein.

Suitable grease nipples 60 may be provided in plate 21 for lubricating the same. As seen in FIG. 4, plate 19 is canted and may include a holder 34 therein engaging spring 31 for holding spring 31 in position. The canting of the plate provides better and more efficient can crushing. Typically the angle of the crush plate can vary between 5 degrees and 10 degrees. An angle of 8 degrees provides quite satisfactory results.

Figure 7:
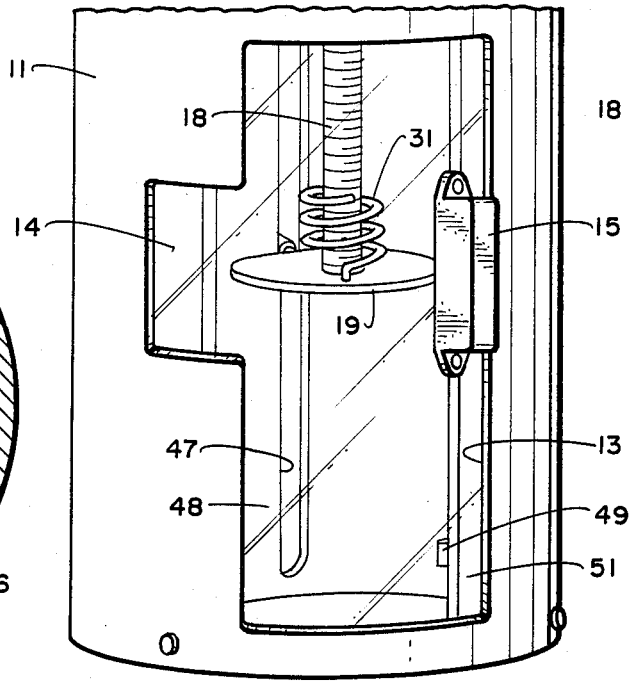
FIG. 7 is a detailed view of a portion of the crusher of FIG. 1 showing the door in closed position.

A reversing switch lever 35 is threadably mounted via threaded shaft 36 to plate 19. Lever 35 is connected, via coil spring 37, to a reversing switch 38. Lever 35 moves up and down within a slot 47 (FIG. 7) formed on the interior wall 48 of housing 11. Switch 38 is also mounted internally of housing 11, as for example within slot 47 above or below the extent of travel of lever 35. In this manner, as lever 35 moves within slot 47, it actuates switch 38 via spring 37 when the plate 19 reaches its bottommost position thereby reversing switch 38 to return plate 19 to its normal inoperative position above bottom ram plate 43.

As seen in FIG. 1, a push button 39 is accessible on the outside of housing 11 for activating motor 22. An electric conduit 40, leading from motor 22 and terminating in plug 41, supplies electrical current to motor 22. Suitable electrical connections are provided as is well known in the art between motor 22 and switch 38 to control the direction of rotation of motor 22. Also, a magnetic switch 49 (FIG. 7) may be provided internally of housing 11 on the interior wall 48 or on a concentrically mounted wall portion, as will be discussed, engaged by door 14 to normally close the switch when the door 14 is closed or open the switch deactivating the motor 22 when the door is open to prevent access to the interior when the door 14 is ajar. Push button switch 39 may include suitable means to activate motor 22 to effect the downward stroke of plate 19 as long as button 39 in held in (thus, stopping downward movement of plate 19 if button 39 is released), then return plate 19 to its normal position prior to crushing after crushing is completed. Also, door 14 is movable within a track 50 (FIG. 1) provided at the bottom of housing 11. Any suitable means may be provided for track 50 such as a concentrically mounted cylindrical spaced wall portion 51 (see FIG. 3) forming a slot with door 14 movable therein. A similar track 50 is thus provided at the top since wall portion 51 may extend up to the top of housing 11. Switch 38 may be mounted on the back of such wall portion 51.

The door 14 may be of transparent cast acrylic plastic and the ram plates 19 and 43 may be of any suitable hard materials, such as aluminum, plastic, steel, etc. Plate 43 may be about 5/16th inch thick. The overall height of crusher 10 may be about 16 to 19 inches. Shaft 18 may be a ½ inch threaded bar with 10 threads per inch. Plate 19 may be about ⅛ inch thick. The crusher 10 may be provided with rubber feet on its undersurface and can crush all aluminum cans, such as 12 oz. to 16 oz. cans. Motor 22 may be a 1/5 hp motor, such as a Dayton AC DC Series 10,000 RPM motor. Suitable insulation and circuit breakers may be provided. Suitable bearings, washers, grease inlets, etc. may also be provided.

Plate 19 may be canted or tilted or otherwise angled from the horizontal as shown in FIG. 4 to provide for efficient crushing. Also, as particularly seen in FIG. 1, shaft 18 is secured to ram plate 19 adjacent one end thereof to assist in more efficient crushing.

It can be seen that there is described a can crusher which can quickly and easily crush cans while permitting one to view the interior thereof to see the crushing take place. Also, opening the door shuts off the motor to stop crushing to prevent injury to the operaor. The crusher herein can be of any suitable size and dimension and can crush all sizes of aluminum cans. It thus need not be cylindrical and may be larger to accomodate large sized cans. Of course, the motor and gearing is selected depending upon the force of crushing desired and the overall dimensions. If desired, the case can be chrome plated.

Figure 8:
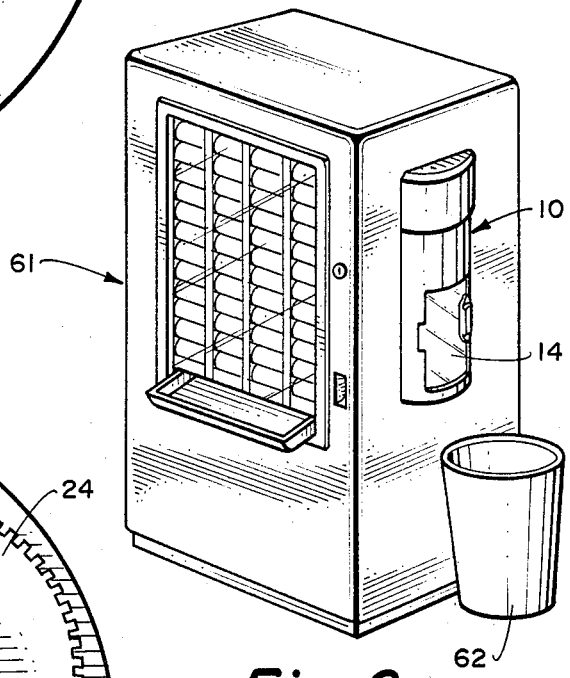
FIG. 8 is a perspective view of a vending machine that incorporates the can crushing means of this invention.

The size of the can crusher as seen lends itself to serving as a home appliance since it is fully enclosed. A second use is illustrated in FIG. 8 wherein the instant device 10 is seen to be set into the body of a vending machine 61. Here the user drinks his or her drink, steps to the side of the vending machine to crush same by opening door 14 as previously discussed and then the user disposes of the can in collection can 62.

It is understood that with reference to FIG. 4, switch 38 is in fact mounted 180 degrees opposite from the location shown. This is to permit direct connection of spring 37 to said switch without the necessity of overlying the alignment slot adjacent designator 47. When so placed, the switch lever 35 will not impact the spring 37 during its traverse. The two dimensional drawing limitation does not allow for the proper depiction, but this mode of illustration was chosen in order to better illustrate the parts in question as opposed to using phantom lines to illustrate unseen parts.

Since certain changes may be made in the above apparatus and method without departing from the scope of the invention herein involved, it is intended that all matter contained in the above description and shown in the accompanying drawings shall be interpreted as illustrative and not in a limiting sense.

I claim:

1. In combination a conventional beer/soda vending machine and an electrically operated can crusher therein, said vending machine having a housing, and said can crusher being disposed within the housing of the vending machine, said housing having an access opening communicating with the interior thereof;

an electrically coupled door in said housing movable from a first position closing off said access opening to a second position exposing said access opening to the atmosphere;

a first ram plate fixedly mounted in said housing at the bottom of said crusher;

a selectively vertically movable second ram plate mounted in said housing above said first ram plate;

reversing means for said second ram plate comprising a spring connected to a motor reversing switch and to said second ram plate.

motor means coupled to said second ram plate adapted to move said second ram plate from a first position above said first ram plate vertically downwardly to a second position directly above said second ram plate to thereby crush a can's ends upon a can being placed between said first and second ram plates, when said second ram plate moves to its second position, said motor means connected to said door, whereby upon opening of said door during operation of said motor means vertical travel of said second ram plate is halted, said motor means also being connected to said reversing switch.

2. An electrically operated can crusher comprising:

a housing having an access opening communicating with the interior thereof;

a manually operated electrically coupled door in said housing movable from a first position closing off said access opening to a second position exposing said access opening to the atmosphere;

a first ram plate fixedly mounted in said housing at the bottom thereof;

a selectively vertically movable second ram plate, a threaded vertically mounted shaft, said second ram plate mounted in said housing above said first ram plate and mounted on the threaded vertically mounted shaft, gearing and motor means in threaded engagement with said threaded shaft, said motor means adapted to move said shaft vertically when said motor means is actuated;

said motor means coupled to said second ram plate and adapted to move said second ram plate from a first position above said first ram plate vertically downwardly to a second position directly above said first ram plate to thereby crush the ends of a can placed vertically between said first and second ram plates when said second ram plate is in its second position;

track means provided in the interior of said housing engaging said door for retaining said door in a predetermined position in said housing, said door being movable within and retained within said track means;

switching means coupled to both said motor means and said door for indicating opening of said door during actuation of said motor means and adapted to stop the actuation of said motor means, and a reversing means comprising a power assist spring connected to a lever, said lever being both vertically disposed in a slot, and connected to said second ram plate, said spring also being connected indirectly to said motor means.

3. In the device of claim 2 further including a motor direction reversing switch wherein the spring connected to the motor means comprises a connection to said reversing switch for the motor.

4. In the can crusher of claim 3 wherein said second ram plate is tilted from the horizontal.

5. In the can crusher of claim 4 wherein said second ram plate is circular and said shaft is connected thereto adjacent the periphery thereof.

6. In the can crusher of claim 2 wherein said reversing means includes a longitudinal slot in the interior wall of said housing, a lever mounted on said second ram plate and extending into said slot and movable therealong, a reversing switch coupled to said motor means mounted internally of said housing, and resilient means interconnecting said reversing switch and said lever whereby said reversing switch is actuated when said lever reaches the second position of said second ram plate to reverse the downward direction of movement of said second ram plate.

7. The can crusher of claim 2 wherein the housing is chrome plated.

* * * * *